US005832938A

United States Patent [19]

Ybarra

[11] Patent Number: 5,832,938

[45] Date of Patent: Nov. 10, 1998

[54] HAIR STYLE HAVING PONYTAIL STRANDS WOVEN INTO CURLS AND TOOL THEREFOR

[76] Inventor: Monica A. Ybarra, 4301 Gordon Way, La Mesa, Calif. 91941

[21] Appl. No.: 884,144

[22] Filed: Jun. 27, 1997

[51] Int. Cl.[6] ..... A45D 7/00

[52] U.S. Cl. ..... 132/210; 132/212; 132/273; 132/276; 66/117; 223/99

[58] Field of Search ..... 132/212, 210, 132/200, 273, 276; 446/15, 16, 296; 119/801, 808; 66/117, 118, 4; 223/99, 102, 50, 105

[56] References Cited

U.S. PATENT DOCUMENTS

| | | | |
|---|---|---|---|
| 2,245,515 | 6/1941 | Williams | 132/50 |
| 2,582,339 | 1/1952 | Krueger | 119/153 |
| 4,607,505 | 8/1986 | Dunker et al. | 66/117 |
| 4,667,860 | 5/1987 | Feuerman | 223/99 |
| 5,036,870 | 8/1991 | Edmark | 132/212 |
| 5,135,422 | 8/1992 | Bowen | 446/15 |
| 5,167,245 | 12/1992 | Harriett | 132/273 |
| 5,279,255 | 1/1994 | Northcutt | 132/212 |
| 5,289,834 | 3/1994 | Lawrence | 132/212 |
| 5,417,230 | 5/1995 | Wood | 132/212 |
| B1 5,036,870 | 7/1995 | Edmark | 132/273 |

*Primary Examiner*—Gene Mancene
*Assistant Examiner*—Pedro Philogene
*Attorney, Agent, or Firm*—John L. Rogitz

[57] ABSTRACT

A method for effecting a curled hair style includes weaving the strands of at least one ponytail through the hair foundation proximal to the ponytail, and then raising portions of the strands away from the foundation to establish respective curled segments of hair. A tool for establishing the hair style includes a cord that defines a noose having a circumference. A needle holds the cord, and the needle has a pointed distal end opposite the noose. A sleeve is slidably received in the needle and is engaged with the cord for selectively establishing the circumference of the noose. With this structure, the sleeve can be manipulated to loosen the noose, a strand disposed in the noose, and then the sleeve manipulated to tighten the noose around the strand to securely hold the strand. Then, the distal end of the needle is advanced into the foundation to accomplish the present weaving.

11 Claims, 3 Drawing Sheets

Fig. 1
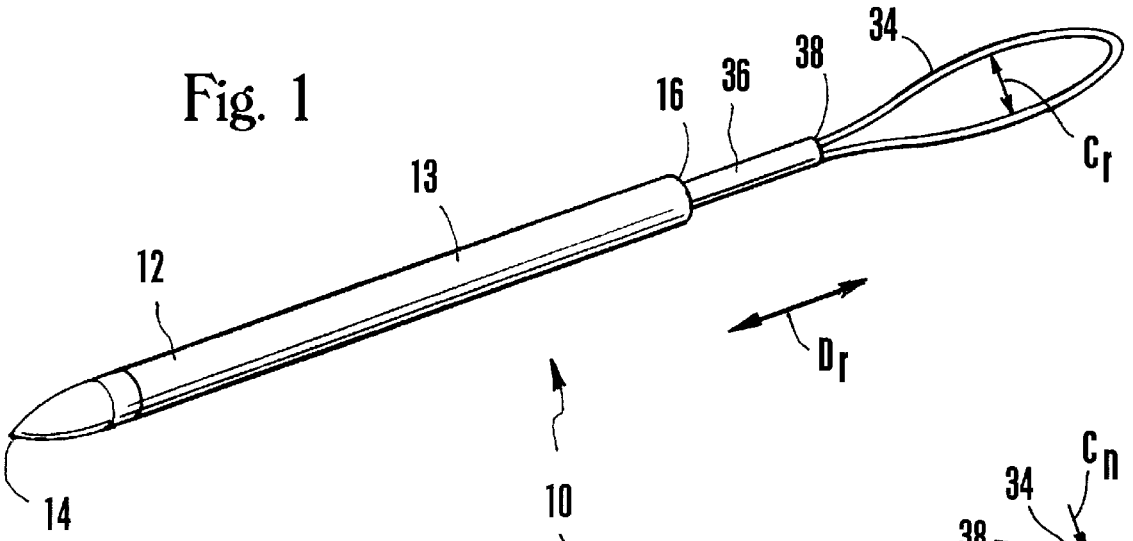
Fig. 2
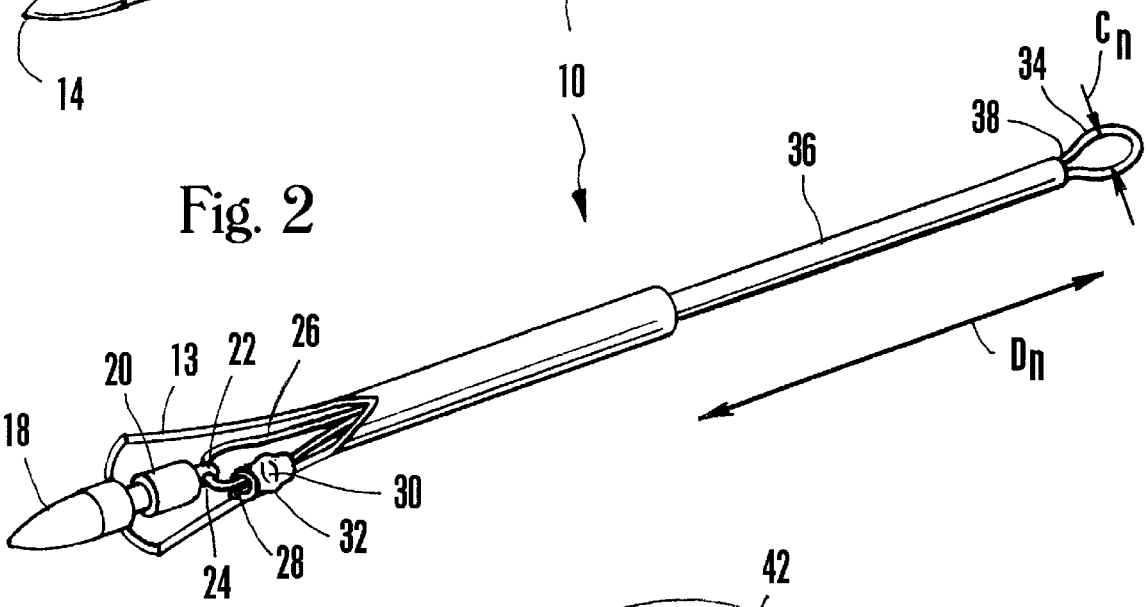
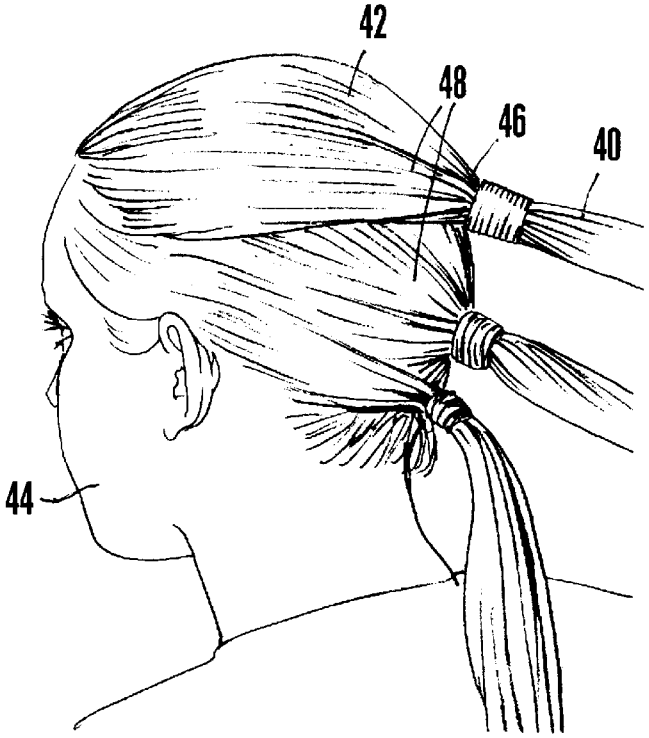
Fig. 3

HAIR STYLE HAVING PONYTAIL STRANDS WOVEN INTO CURLS AND TOOL THEREFOR

FIELD OF THE INVENTION

The present invention is related generally to hair styling, and more particularly to methods and apparatus for weaving strands of hair such that the hair presents a pleasing curled appearance.

BACKGROUND

Hair styles that provide curls in a person's hair are popular, because curly hair is widely regarded as presenting a pleasant appearance. Many people, however, have straight hair, and accordingly must have their hair styled to achieve a curled appearance, if such is desired.

Not surprisingly, several techniques exist for curling hair. Among these techniques are to wrap strands of the hair around a cylindrical object such as a curling iron or curlers, and then treat the hair such that the strands, once removed from the cylindrical object, are materially biased in a curled configuration as normally curled hair would be. Treatments that are used to cause the hair to retain a curled configuration include the deposition of stiffening chemicals on the hair. Such treatments initially can be effected on a person by a professional hairdresser, and then the material bias of the hair in the curled configuration can be maintained by daily styling that is typically undertaken by the person.

As recognized herein, it can be relatively time consuming to treat hair on a daily basis to retain the curled appearance of the hair. As further recognized herein, the use of chemical treatments can be unpleasant for many people. With the above considerations in mind, the present invention recognizes that it is possible to provide a curled hair style that does not require treating normally straight hair such that the hair becomes materially biased in a curl.

In providing my new hair styling method, I have recognized a need to provide a tool for both gripping and weaving strands of hair as disclosed herein, because previous tools, which were not intended for my particular use, are inadequate for my purposes. For example, U.S. Pat. No. 5,289,834 discloses a tool for threading an entire ponytail through a single loose bight of the ponytail, with the '834 invention including a looped cord and a tubular body slidably engaged with the cord for tightening and loosening the loop of the cord around a ponytail. The free ends of the cord are anchored in a small lever that can be gripped and pulled as the tubular body is held to thereby tighten the cord around the ponytail prior to threading the ponytail once through itself.

Unfortunately, were such a device to be used to undertake my novel styling, hair would undesirably and perhaps painfully be caught and snagged between the end of the tubular body and the lever during weaving. Moreover, with the loop drawn tight to hold hair, the lever of the '834 invention is distanced from the body with only the cord extending between the lever and body. Consequently, the '834 combination of structure is not sufficiently axially rigid to push through tightly bunched hair, in contrast to what I require in my new styling. This is not surprising, because the '834 patent is directed simply to threading a ponytail once through its own loose bight. In contrast, my invention requires repeated weaving of many strands of a ponytail through the relatively tightly packed foundation of hair that is established between the ponytail and the scalp.

Accordingly, it is an object of the present invention to provide a method for causing hair to assume a curled appearance. Another object of the present invention is to provide a method for causing hair to assume a curled appearance, without the need for chemicals to materially bias the hair into curls. Still another object of the present invention is to provide a tool for gripping and weaving strands of hair through a relatively tightly packed hair foundation. Yet another object of the present invention is to provide a method and tool for curling hair which are easy to use and cost-effective.

SUMMARY OF THE INVENTION

The details of the present invention, both as to its structure and operation, can best be understood in reference to the accompanying drawings, in which like reference numerals refer to like parts, and in which:

BRIEF DESCRIPTION OF THE DRAWINGS

FIG. 1 is a perspective view of the present tool in the release configuration;

FIG. 2 is a partially cut-away view of the present tool in the hold configuration;

FIG. 3 is a perspective view of a person's head, with several ponytails established above to a hair foundation;

DETAILED DESCRIPTION OF THE PREFERRED EMBODIMENT

Figure 4:
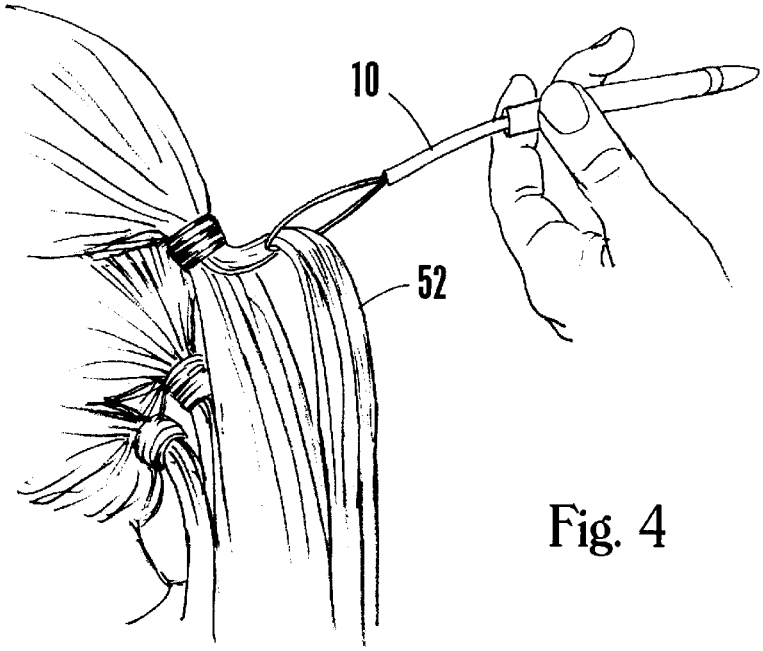
FIG. 4 is a perspective view of a person's head, showing the present tool engaged with a strand of a ponytail, with the tool in the release configuration.

Referring initially to FIGS. 1 and 2, a tool, generally designated 10, is shown for guiding strands of a ponytail through a hair foundation on a person's head in accordance with the novel hair styling steps disclosed below. As shown in FIGS. 1 and 2, the tool 10 includes an elongated, hollow plastic, generally cylindrical needle 12 that has a body 13, a pointed closed distal tip 14, and an open proximal end 16 opposite the distal tip 14. It is to be understood that the distal tip 14 is pointed but not sharp, and that the tip 14 consequently is configured for penetrating the hair foundation, as more fully disclosed below.

In the presently preferred embodiment, the body 13 of the needle 12 is made of flexible resilient black nylon, and thus is somewhat transversely flexible. Nonetheless, owing to its length, the needle 12 is substantially axially rigid. In other words, the needle 12 is made of a plastic that possesses sufficient axial rigidity to permit the needle 12 to be pushed lengthwise, distal tip 14 first, through relatively tightly-packed hair.

In one preferred embodiment, the distal tip 14 of the needle 12 is established by a hard rigid plastic nosecone 18, the outer surface of which is flush with the outer surface of the body 18. As shown best in FIG. 2, the nosecone 18 includes a medial segment 20 having a cylindrical surface that is received in the distal segment of the body 13 of the needle 12 in an interference fit therewith, such that the nosecone 18 does not move relative to the body 13. In accordance with the present invention, no glue or other adhesive is used to attach the nosecone 18 to the body 13, to thereby facilitate sanitizing the tool 10 in a liquid solution.

Additionally, the medial segment 20 is contiguous to a proximal segment 22, with the proximal segment 22 having a smaller diameter than that of the medial segment 20. A radial orifice 24 is formed transversely through the proximal segment 22 as shown.

Still referring to FIGS. 1 and 2, a cord 26 that has first and second ends 28, 30 (second end 30 shown in phantom in FIG. 2) is engaged with the needle 12, with the ends 28, 30 of the cord 26 being fixedly disposed within the needle 12. More specifically, the cord 26 extends through the orifice 24 in the proximal segment 22 of the nosecone 18. Consequently, the cord 26 is affixed to the nosecone 18. Preferably, the cord 26 is a multistrand stainless steel cord that is encased in plastic, to facilitate disinfecting the tool 10 without causing the cord 26 to rust. Moreover, a bronze crimping element 32 is disposed in the needle 12 close to the nosecone 18, and as shown, the crimping element 32 is crimped around the ends 28, 30 of the cord 18 to hold the ends 28, 30 together.

FIGS. 1 and 2 show that with the above-disclosed cooperation of structure, the cord 26 defines a noose 34 that is beyond the open proximal end 16 of the needle 12. To provide a means for loosening the noose 34 to receive a strand of hair therethrough, and to then tighten the noose 34 to hold the hair, a hollow noose sizing element surrounds at least part of the cord 26. The noose sizing element can be a ring, but in the preferred embodiment the noose sizing element is an elongated hollow cylindrical vinyl sleeve 36 that defines an open proximal end 38 which is juxtaposed with the noose 34, with the sleeve 36 being slidably disposed in the needle 12 and also being slidably disposed around the cord 26.

More particularly, the sleeve 36 is reciprocatingly received in the needle 12 for movement to a release position shown in FIG. 1, wherein the proximal end 38 of the sleeve 36 defines a release distance $D_r$ to the proximal end 16 of the needle 12. In the release configuration, the noose 34 defines a release circumference $C_r$. Also, as shown in FIG. 2 the sleeve 36 can be moved relative to the needle 12 to a hold position. In the hold position, the proximal end 38 of the sleeve 36 defines a hold distance $D_h$ to the proximal end 16 of the needle 12 and the noose 34 defines a hold circumference $C_h$. In accordance with the present invention, the sleeve 36 is sufficiently long that in both the hold and release configurations, a portion of the sleeve 36 remains in the needle 12, with the noose 34 retaining the sleeve 36 on the cord 26. Also, the sleeve 36 is sufficiently long such that the most proximal segment of the sleeve 36 protrudes from the needle 18 in the release configuration.

In cross-reference to FIGS. 1 and 2, the hold distance $D_h$ is greater than the release distance $D_r$ and the hold circumference $C_h$ is smaller than the release circumference $C_r$. Accordingly, the skilled artisan will appreciate that the sleeve 36 can be manipulated relative to the needle 12 to the release configuration to facilitate disposing a strand of hair in the noose 34. Then, the sleeve 36 can be manipulated to the hold configuration to tighten around the hair to hold the hair.

Now referring to FIGS. 3–9, the details of the present hair styling method can be seen. FIG. 3 shows that at least one and preferably plural ponytails 40 are established by gathering the hair 42 of a person 44 tightly at respective locations 46, next to the scalp of the person 44. In so doing, a tightly packed hair foundation 48 is established that covers at least a portion of the head 42 of the person 44. The locations 46 can be established by wrapping strands of hair around the bases of respective ponytails as shown.

Figure 5:
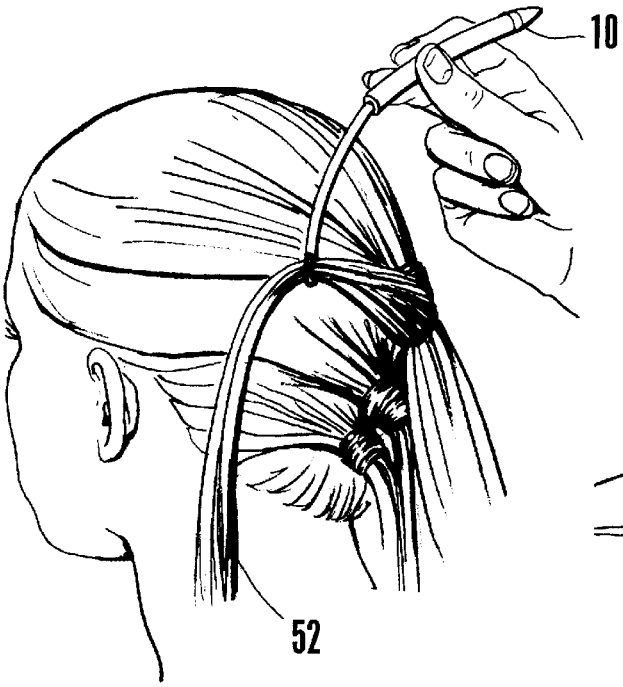
FIG. 5 is a perspective view of a person's head, showing the present tool engaged with a strand of a ponytail, with the tool in the hold configuration.
Figure 6:
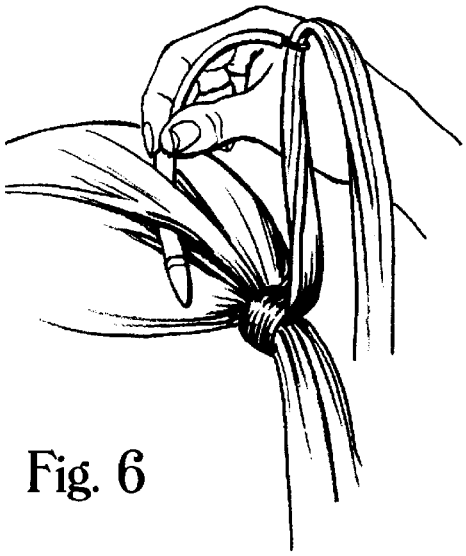
FIG. 6 is a perspective view of a person's head, showing the present tool engaged with a strand of a ponytail, with the tool in the hold configuration and with the distal tip of the tool being woven through the hair foundation.

Next, as shown in FIG. 4, with the tool 10 in the release configuration a first strand 52 of one of the ponytails 40 is disposed in the noose 34. FIG. 5 shows that the noose 34 is then tightened as described above to firmly hold the strand 52. Then, as shown in FIG. 6 the first strand 52 of the ponytail 40 is woven into the foundation 48 by advancing the tool 10, distal end 14 first, into and through the foundation 48.

Figure 7:
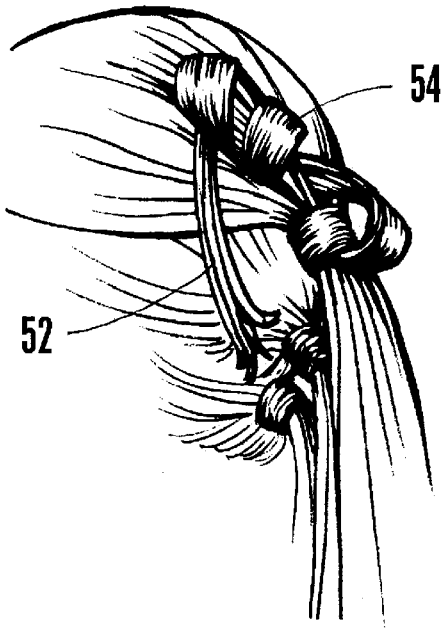
FIG. 7 is a perspective view of a person's head, showing the strand after it has been woven several times through the hair foundation to establish plural curled segments.

As intended by the present invention and as can be appreciated in reference to FIG. 7, the tool 10 with strand 52 is advanced into and through the foundation 48 plural times to thereby weave the strand 52 into the foundation 48. FIG. 7 shows that the above-disclosed weaving establishes curl segments 54 of the first strand 52, with each curl segment 54 defining a respective arcuate curl on the foundation 56. When the strand 52 has been completely woven into the foundation 48, the tool 10 is moved to the release configuration to release the strand 52 from the noose 34.

Figure 8:
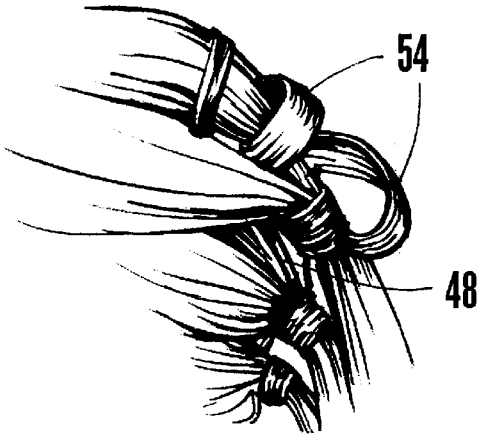
FIG. 8 is a perspective view of a person's head, showing the strand after it has been woven several times through the hair foundation and after the tool has been manipulated to raise the curled segments from the hair foundation.
Figure 9:
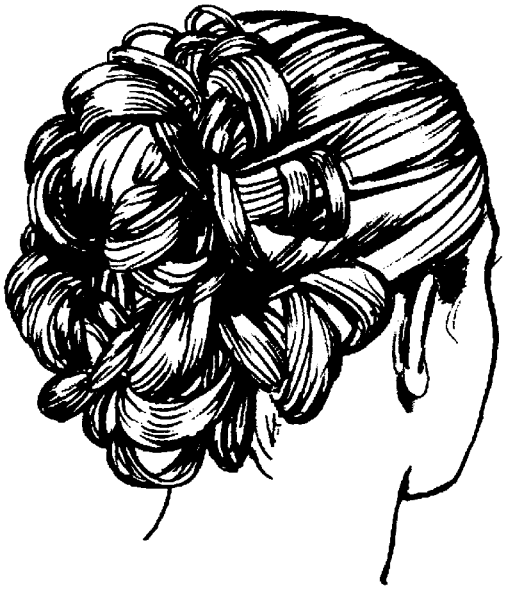
FIG. 9 is a perspective view of a person's head, showing the final hair styling result of the present invention.

Next, it is to be understood that the distal end 14 of the tool 10 is advanced between the curl segments 54 and the foundation 48, and then pulled away from the head 42 to raise the curl segments 54 above the foundation 48, as shown in FIG. 8, with no remaining part of the strand 52 remaining visible above the foundation 48. Successive strands of the ponytail 40 are then woven into the foundation 48 as described above with respect to the first strand 54, until substantially the entire ponytail 40 has been woven into the foundation 48. The remaining ponytails 40 are then woven into the foundation 48 to thereby present the curled hair style shown in FIG. 9.

While the particular HAIR STYLE HAVING PONYTAIL STRANDS WOVEN INTO CURLS AND TOOL THEREFOR as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. A tool for guiding strands of a ponytail through a hair foundation on a person's head, comprising:

an elongated hollow needle having a pointed distal tip configured for penetrating the hair foundation, the needle having an open proximal end;

a cord at least partially disposed within the needle such that the cord defines a noose beyond the open proximal end of the needle; and a hollow noose sizing element surrounding at least part of the cord and defining an open proximal end juxtaposed with the noose, the noose sizing element being slidably disposed relative to the needle for movement between a release position, wherein the proximal end of the noose sizing element defines a release distance to the proximal end of the needle and wherein the noose defines a release circumference, and a hold position, wherein the proximal end of the noose sizing element defines a hold distance to the proximal end of the needle and wherein the noose defines a hold circumference, the hold distance being greater than the release distance and the hold circumference being smaller than the release circumference.

2. The tool of claim 1, wherein the noose sizing element is an elongated sleeve, and the sleeve is reciprocatingly received in the needle.

3. The tool of claim 2, wherein the sleeve and the needle are made of plastic.

4. The tool of claim 3, wherein the cord is encased in a plastic sheath to facilitate disinfecting the cord.

5. The tool of claim 4, wherein the needle includes:

a hollow cylindrical body defining the proximal end and having an open distal end; and a pointed nosecone received in the distal end of the body for defining the distal tip of the needle.

6. The tool of claim 5, wherein the nosecone is formed with a proximal orifice, the cord defines first and second ends, and the cord is received through the orifice, and the tool further comprises:

a crimping element disposed in the needle and surroundingly engaged with the ends of the cord to hold the ends together.

7. A tool for weaving hair, comprising:

a cord establishing a noose having a circumference;

a needle holding the cord and having a pointed distal end opposite the nooses, the needle defining a proximal end; and a sleeve slidably disposed in the needle for movement between a release position, wherein a proximal end of the sleeve defines a release distance to the proximal end of the needle and wherein the noose defines a release circumference, and a hold position, wherein the proximal end of the sleeve defines a hold distance to the proximal end of the needle and wherein the noose defines a hold circumference, the hold distance being greater than the release distance and the hold circumference being smaller than the release circumference.

8. The tool of claim 7, wherein the sleeve and the needle are made of plastic.

9. The tool of claim 8, wherein the cord is encased in a plastic sheath to facilitate disinfecting the cord.

10. The tool of claim 9, wherein the needle includes:

a hollow cylindrical body defining the proximal end and having an open distal end; and a pointed nosecone received in the distal end of the body for defining the distal tip of the needle.

11. The tool of claim 10, wherein the nosecone is formed with a proximal orifice, the cord has first and second ends disposed within the needle, and the cord is received through the orifice, and the tool further comprises:

a crimping element disposed in the needle and surroundingly engaged with the ends of the cord to hold the ends together.

* * * * *